US007401850B2

(12) United States Patent
Micheel

(10) Patent No.: US 7,401,850 B2
(45) Date of Patent: Jul. 22, 2008

(54) LOCKING DEVICE FOR COLLAPSIBLE SEAT

(76) Inventor: Thomas G. Micheel, 5114 Herbert Dr., Columbia, MD (US) 21045

( * ) Notice: Subject to any disclaimer, the term of this patent is extended or adjusted under 35 U.S.C. 154(b) by 24 days.

(21) Appl. No.: 11/375,799

(22) Filed: Mar. 14, 2006

(65) Prior Publication Data

US 2007/0216212 A1 Sep. 20, 2007

(51) Int. Cl.
*A47C 4/00* (2006.01)
*A47B 3/00* (2006.01)

(52) U.S. Cl. ..... 297/16.2; 297/451.2; 297/42; 297/195.11; 248/164; 108/118

(58) Field of Classification Search ..... 297/16.2, 297/451.2, 42, 45, 195.11, 461; 108/118, 108/119, 120; 248/164, 440
See application file for complete search history.

(56) References Cited

U.S. PATENT DOCUMENTS

| | | | | | |
|---|---|---|---|---|---|
| 115,598 | A | | 6/1871 | Free | |
| 509,005 | A | * | 11/1893 | Voeltzkow | 248/431 |
| 615,476 | A | * | 12/1898 | Chapman | 108/118 |
| 647,171 | A | * | 4/1900 | Wiles | 108/118 |
| 801,405 | A | * | 10/1905 | Shupe | 108/118 |
| 1,896,446 | A | * | 2/1933 | Goeller | 403/57 |
| 1,961,241 | A | * | 6/1934 | McKenney | 108/99 |
| 2,710,733 | A | | 6/1955 | Phillips | |
| 2,845,317 | A | * | 7/1958 | Orman | 248/164 |
| 3,709,167 | A | | 1/1973 | Sprigman | |
| 4,359,243 | A | | 11/1982 | Crutcher | |
| 4,934,638 | A | * | 6/1990 | Davis | 248/164 |
| 5,044,507 | A | * | 9/1991 | Shulyak | 211/203 |
| 5,851,052 | A | | 12/1998 | Gustafsson | |
| 5,876,091 | A | | 3/1999 | Chernomashentsev | |
| 6,135,557 | A | | 10/2000 | Gustafsson | |
| 6,585,315 | B1 | | 7/2003 | Vail | |
| 6,634,704 | B1 | * | 10/2003 | Bergquist | 297/16.2 |
| 6,799,797 | B2 | * | 10/2004 | Cochran et al. | 297/16.2 |
| 6,871,905 | B2 | | 3/2005 | Grace | |
| 6,945,597 | B1 | | 9/2005 | Brown et al. | |
| 6,981,741 | B2 | | 1/2006 | Sirjoo | |
| 2004/0145221 | A1 | | 7/2004 | Suzuki | |

FOREIGN PATENT DOCUMENTS

| | | |
|---|---|---|
| WO | WO 99/20156 | 4/1999 |

* cited by examiner

*Primary Examiner*—Sarah B McPartlin

(57) ABSTRACT

A locking device for a foldable collapsible seat is provided. The collapsible seat includes a plurality of legs. A pivoting mechanism pivotally connects together the plurality of legs. A seat portion is mounted to an upper end of the plurality of legs. A locking device is removably positioned above the pivoting mechanism for wedging apart the plurality of legs and increasing a rigidity of the collapsible seat in an expanded, setup position.

6 Claims, 12 Drawing Sheets

LOCKING DEVICE FOR COLLAPSIBLE SEAT

BACKGROUND

The present invention relates to an improvement to a foldable and collapsible seat, and more particularly, relates to a safety and locking device for a foldable and collapsible seat which prevents the legs of the seat from inadvertently collapsing. The present invention finds particular application in conjunction with a foldable three-leg seat, and will be described with particular reference thereto. However, it is to be appreciated that the present invention is also amenable to other like applications.

It has often been desired to provide a portable collapsible seat which may be conveniently transported from place to place. It is also desired to provide a portable seat which may be reduced to a small size for ease of carrying and storage. Conventionally, tripod or three-leg seats have been utilized to provide portable seating. However, such tripod seats are generally unstable. The legs have a tendency to move with respect to one another, particularly upon movement of the seat. Still another problem is the undesirable movement of a seat portion with respect to the legs when the user is sitting on the seat portion.

A need therefore exists for a locking device for a portable foldable and collapsible seat which prevents the legs of the seat from unintentionally collapsing during use and movement of the seat.

SUMMARY OF THE INVENTION

In one non-limiting aspect of the present invention, a locking device for a foldable collapsible seat is provided.

In one non-limiting embodiment of the present invention, there is provided a collapsible seat including a plurality of legs, a pivoting mechanism for pivotally connecting together the plurality of legs, and a seat portion mounted to an upper end of the plurality of legs. The locking device for the seat includes a top wall, a bottom wall and a plurality of side walls. In one non-limiting aspect of this embodiment, a plurality or all of the side walls of the locking device engage an inner surface of a leg. In another non-limiting aspect of this embodiment, the locking device is removably positioned above the pivoting mechanism for wedging apart the plurality of legs and/or increasing a rigidity of the collapsible seat in an expanded, setup position.

In accordance with another non-limiting embodiment of the present invention, the locking mechanism for a collapsible seat includes a locking device having a top wall, a bottom wall and a plurality of side walls. Each side of the locking device is contoured for matingly engaging an inner surface of a leg. In one non-limiting aspect of this embodiment, a static connecting and tensioning cord releasably mounts the locking device above the pivoting mechanism to the pivoting mechanism.

In accordance with yet another non-limiting embodiment of the present invention, a collapsible tripod seat includes three legs, each leg having an upper end and a lower end. A pivoting mechanism movably secures the legs together. A limiter device extends between the legs for preventing the legs from spreading beyond a predetermined supporting position. A flexible seat is connected to the upper ends of the three legs. A removable locking device is postitionable above the pivoting mechanism. The locking device increases a rigidity of the seat when positioned above the pivoting mechanism.

As can be appreciated, other non-limiting aspects of the disclosure will become apparent from reading and understanding the description of the preferred embodiments below.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION

It should, of course, be understood that the description and drawings herein are merely illustrative and that various modifications and changes can be made in the structures disclosed herein without departing form the spirit of the invention. Like numerals refer to like parts throughout the several views. It will also be appreciated that the various identified components of a portable collapsible seat disclosed herein are merely terms of art that may vary from one manufacturer to another and should not be deemed to limit the present invention.

Figure 1:
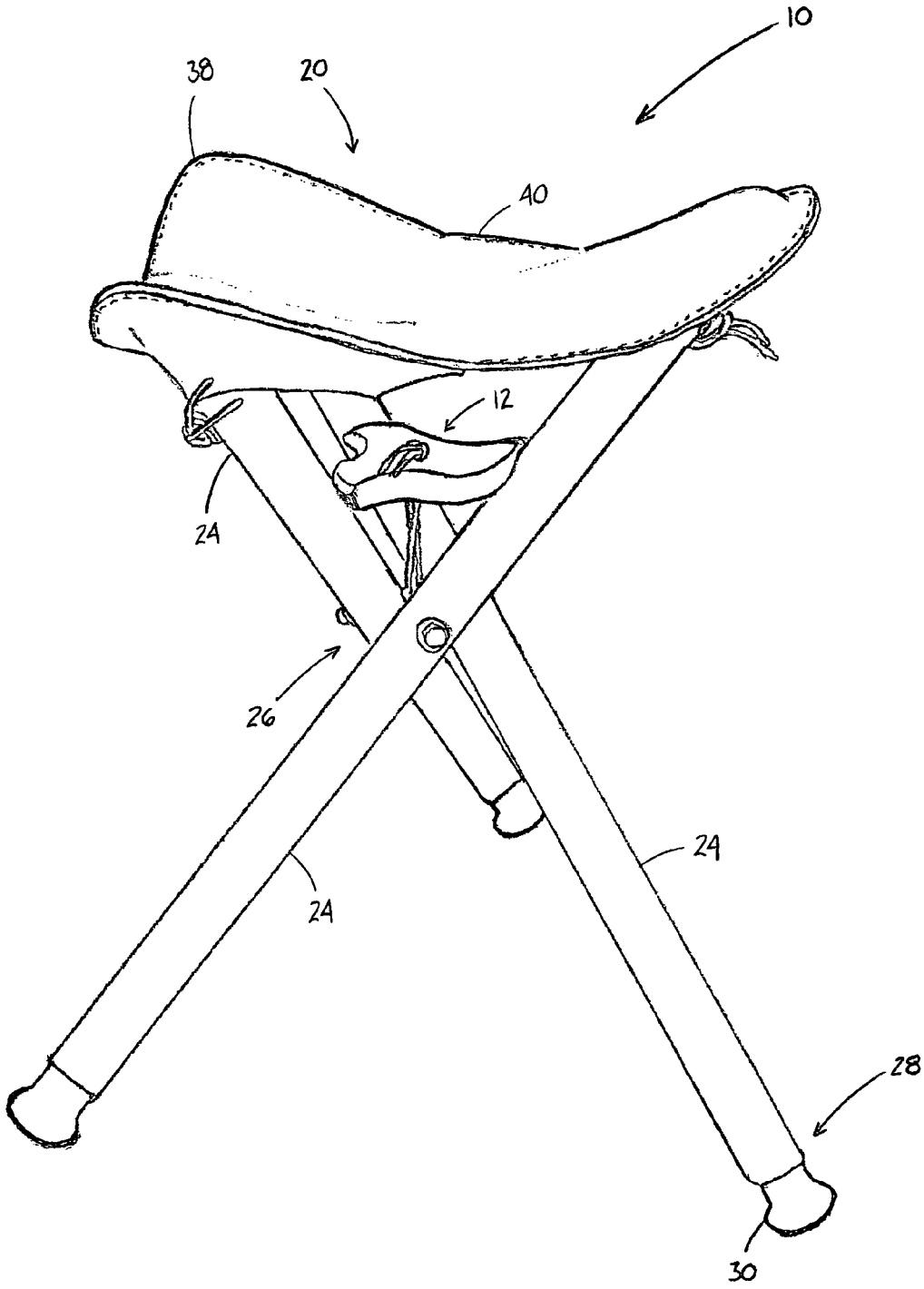
FIG. 1 is a side perspective view of a collapsible seat in an expanded setup position including a locking device in accordance with a first embodiment of the present invention.
Figure 2:
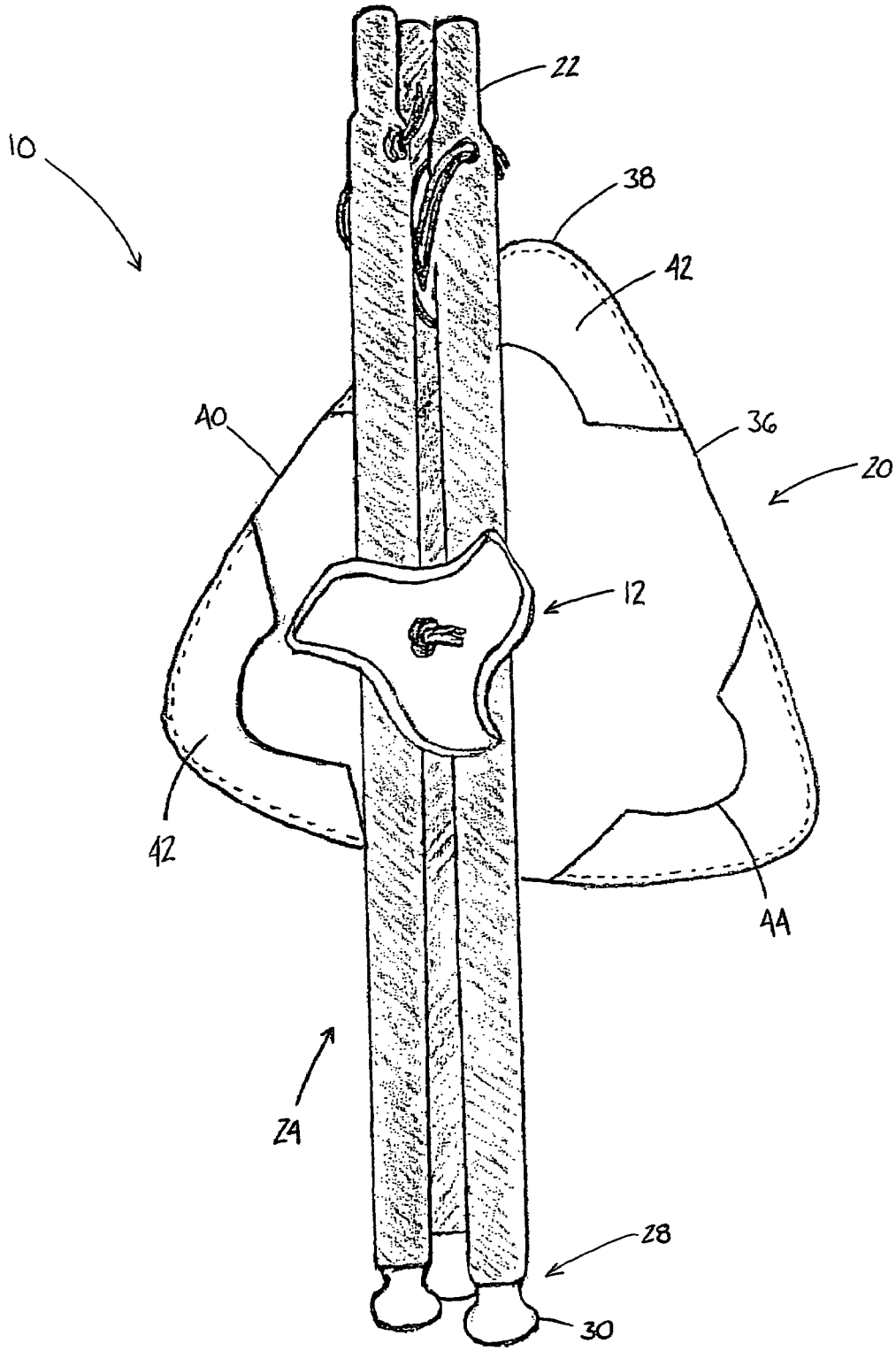
FIG. 2 is a side perspective view of the collapsible seat of FIG. 1 in a fully collapsed position.
Figure 3:
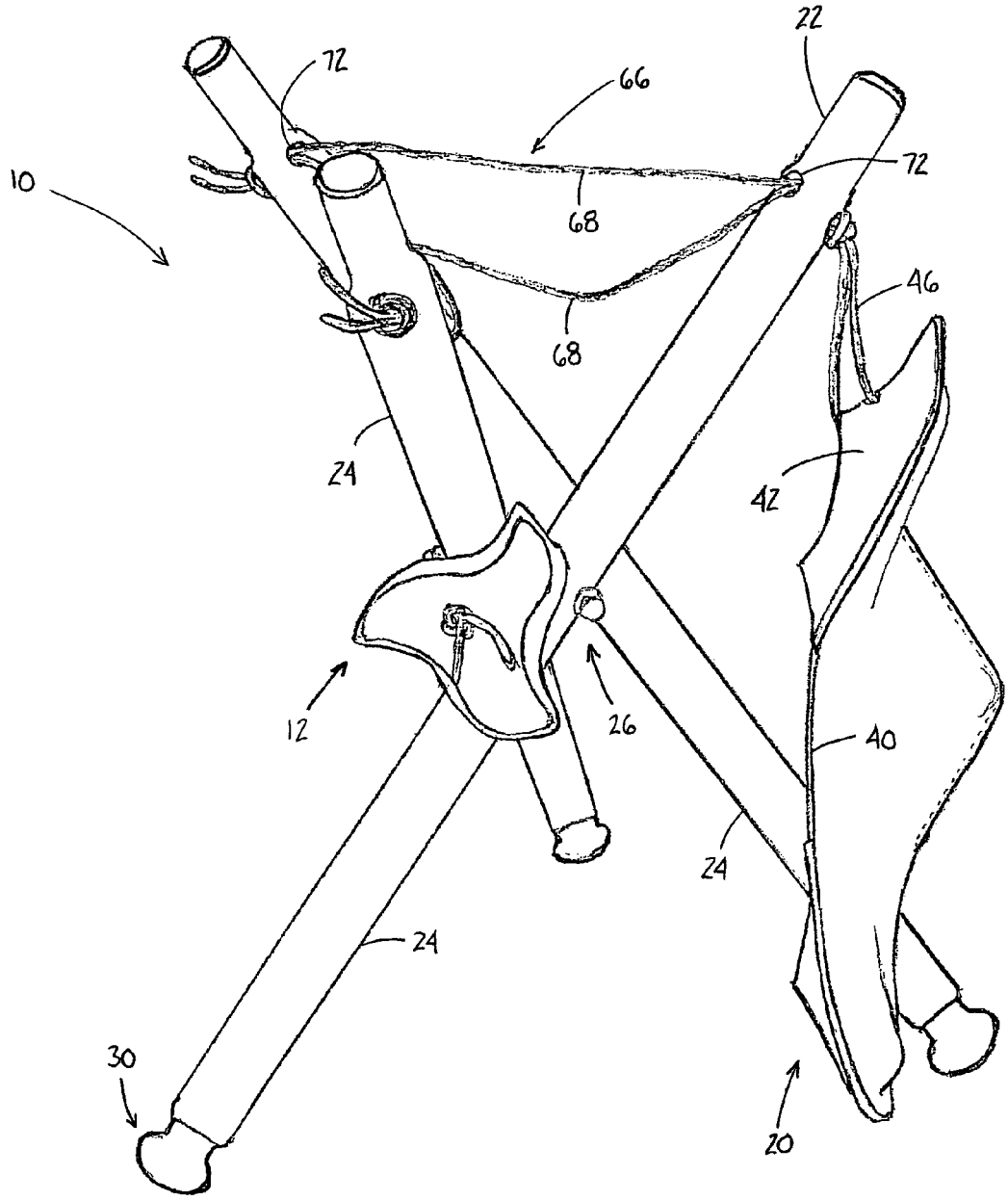
FIG. 3 is a side perspective view of the collapsible seat of FIG. 1 in a partially expanded position.

Referring now to the drawings, wherein the showings illustrate an embodiment of the invention only and are not intended to limit same, FIGS. 1-3 show a collapsible seat 10 including a stabilizing, locking device 12 in accordance with the present invention. The collapsible seat generally includes a support surface or seat portion 20 removably connected to an upper end 22 of at least three axially extending legs 24 that converge towards and are pivotally connected to a pivoting mechanism 26. The pivoting mechanism supports the legs for movement between an expanded setup position (FIG. 1) and a folded or collapsed position (FIG. 2). The seat portion 20 is maintained in a substantially horizontal seating position by the legs 24 when the seat is in the setup position resting on a generally horizontal supporting surface. A lower or bottom end 28 of each leg can include an end cap 30 that is attached thereto; however, this is not required. The end cap, when used, can be made from rubber, plastic or any suitable material for gripping the supporting surface.

The seat portion 20 is adapted for supporting a person sitting on the seat 10. The seat portion can be triangular shaped; however, this is not required. A triangular configuration, when used, can result in inherent stability when the seat is in its setup position and yet has minimal volume and weight for storage and carrying. The seat portion can be made of a sturdy flexible material to facilitate in the collapsing of the seat, such as, but not limited to, leather, Kevlar, Nylon, cotton, linen, and the like. The seat portion can be formed from a triangular sheet of flexible fabric having leather reinforcement patches at its apexes; however, this is not required.

Figure 4:
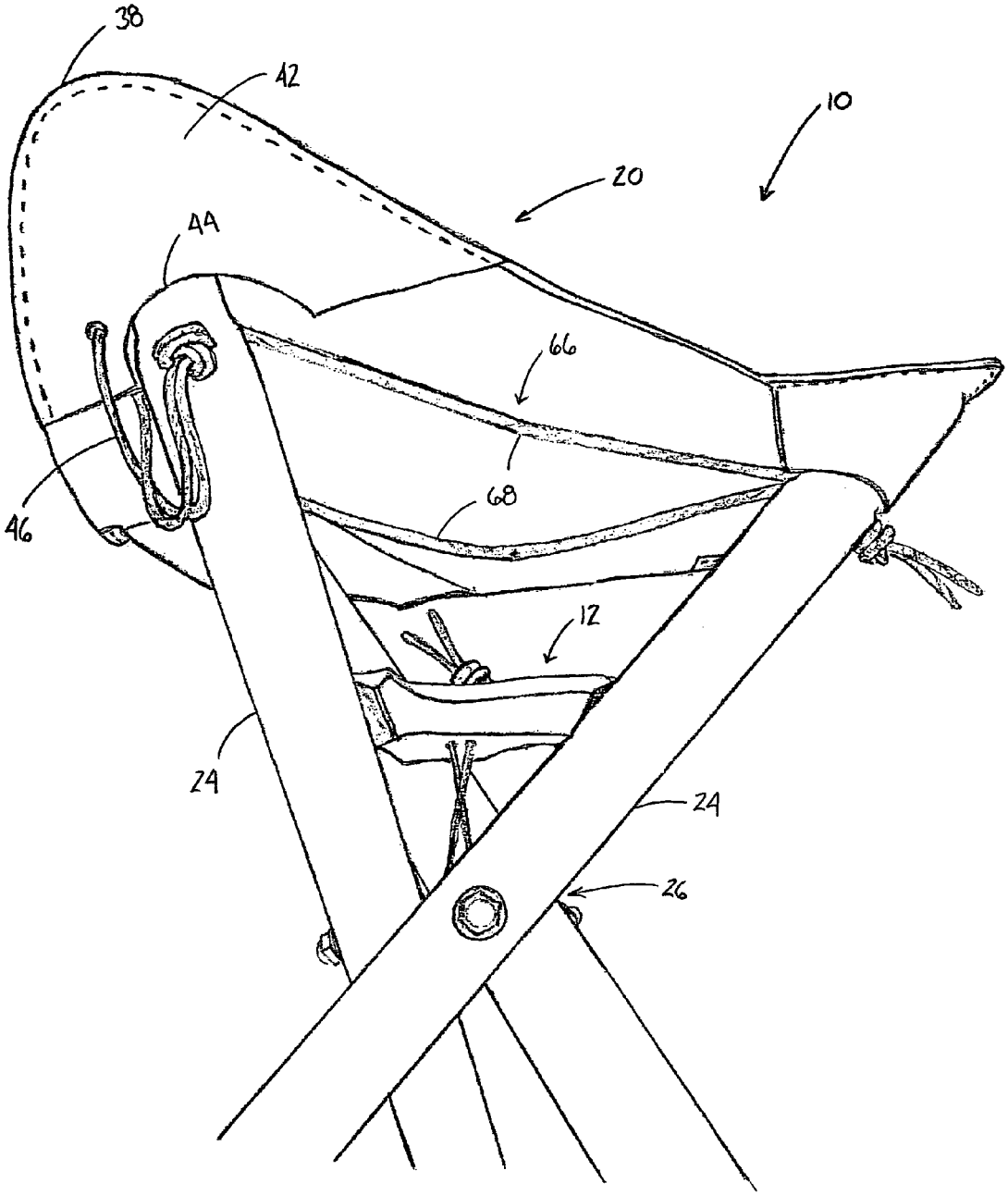
FIG. 4 is an enlarged side perspective view of the collapsible seat of FIG. 1 in the setup position.

With continued reference to FIGS. 1-3, the seat portion 20 can include stitched side edges 36 and corners 38; however, this is not required. The side edges can each have a concave midsection 40 disposed between the corners 38; however, this is not required. An underside of each corner includes a downwardly open pocket 42 which receives the upper end 22 of one of the legs 24 therein (FIG. 4). The pockets can be used to releasably secure the seat portion to the legs. As shown in FIG. 2, each pocket can include a cutout 44 for ease of insertion and removal of the upper ends 22 of the legs 24 into and out of the pockets. The upper ends of the legs can include a generally smooth or profiled surfaces to facilitate insertion and removal of the legs from the pockets 42. The seat portion 20 can be attached to the upper end of each of the legs by a variety of arrangements (e.g., tacks, nails, screws, adhesive, cord, and the like). In the depicted embodiment, a strap or cord 46 can be attached at one end to one of the pockets 42 of the seat portion 20 and at the other end to one of the legs 24; however, this is not required. The strap ensures that the seat portion 20 remains with the seat 10 when the seat is in the collapsed position.

Figure 5:
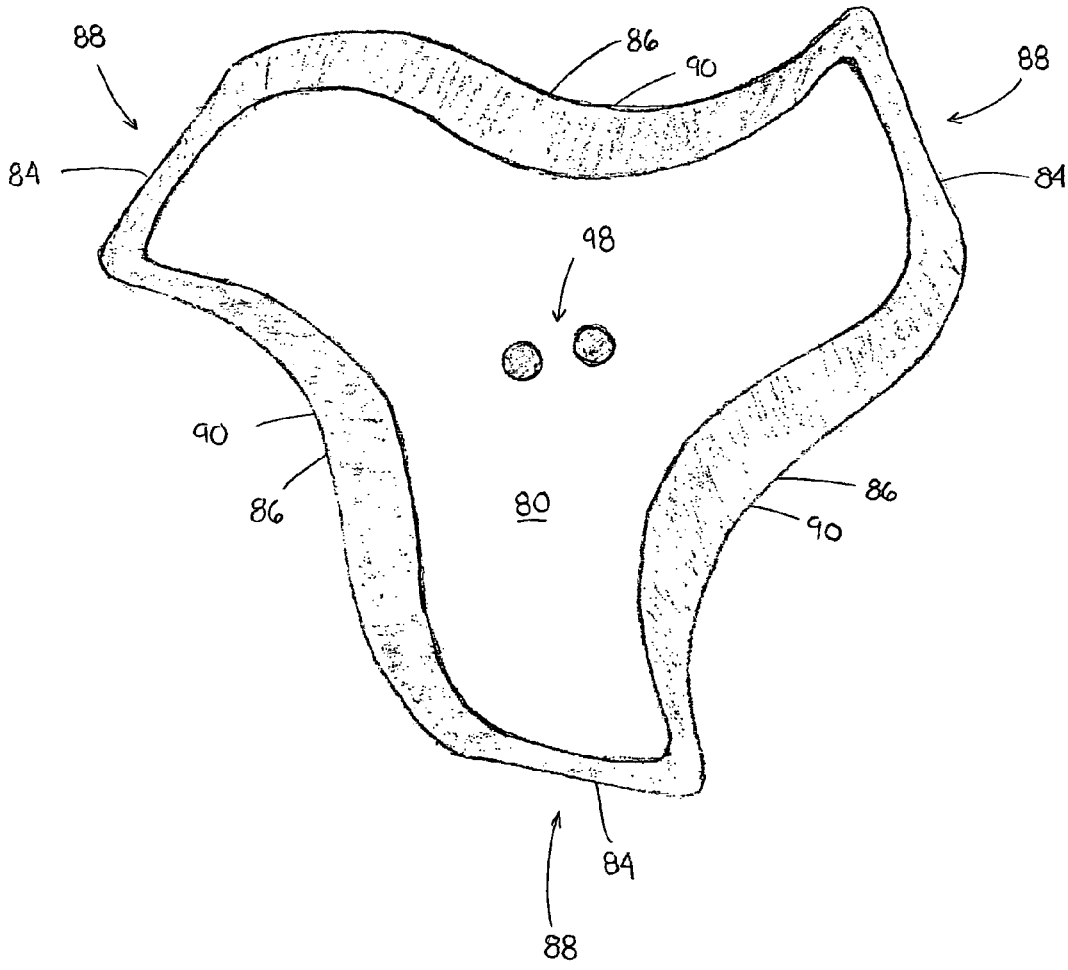
FIG. 5 is a top plan view of the locking device of FIG. 1.

The legs 24 of the collapsible seat 10 are connected to one another intermediate the upper and lower ends via the pivoting mechanism 26 for mutual pivotal movement between folded or collapsed and setup positions. The legs may be connected together in any suitable manner which permits mutual pivotal movement of two or more of the legs relative to each other. As shown in FIG. 5, the pivoting mechanism 26 includes a central Y-bolt 50 for pivotally connecting the three legs 24 together. As can be appreciated, other shapes of the pivoting mechanism can be used. As can further be appreciated, the pivoting mechanism can be used to secure together more than three legs. The Y-bolt 50 is designed to provide pivotal connection between the legs and enable one or more of the legs to at least partially rotate about an axis of a threaded shank 52 of the Y-bolt that is inserted at least partially through each leg. The movement of the one or more legs relative to the Y-bolt 50 enables the seat to be folded or collapsed. The threaded shank 52 of the Y-bolt 50 penetrates and extends transversely through a connector opening 56 in at least two of the legs and a nut 58 is secured to the end of the threaded shank to secure two of more of the legs to the Y-bolt 50.

Each leg 24 is generally made from rigid and durable materials, such as, but not limited to, wood, metal, plastic and/or other polymer materials, carbon fiber materials, and the like. In the illustrated embodiment, the legs are one piece legs; although, it should be appreciated that the legs can be telescoping legs having an upper cylindrical segment and a lower cylindrical segment sized to slide fit within the upper cylindrical segment.

A limiter device can extend between the legs for preventing the legs from spreading beyond a predetermined supporting position. With reference again to FIGS. 3 and 4, the limiting device includes a limiter cord 66 coupled to at least one of the upper end 22 and the lower end 28 of two or more of the legs 24 to form a loop for preventing the upper or lower ends of two or more of the of legs from spreading beyond a predetermined supporting position. The limiter cord can also or alternatively be used to prevent the legs from stretching the pockets 42 of the seat portion 20, which, in turn, could cause the upper ends 22 of the legs 24 to slide out of the pockets. In this embodiment, the limiter cord 66 includes equal length sections 68, however, this is not required. The sections 68 span between the upper ends 22 of the legs 24 in a generally triangular configuration. Each section of the limiter cord has opposed ends threaded through cord openings 72 located in each leg upper end. The ends of each section 68 can be tied, thereby securing the limiter cord sections to the legs. However, alternative fastening means for securing the limiter cord to the legs are also contemplated.

Figure 6:
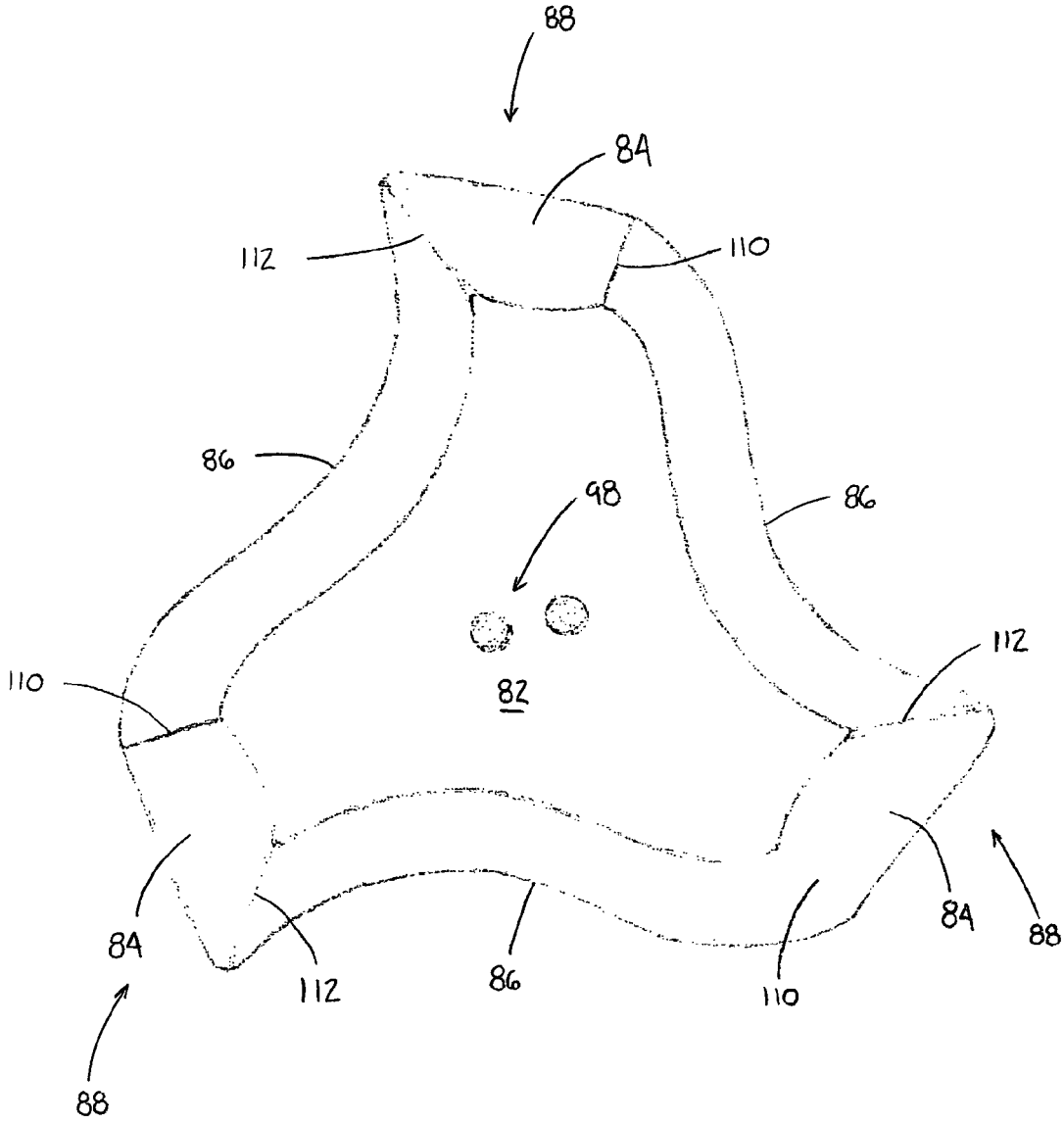
FIG. 6 is a bottom plan view of the locking device of FIG. 1.
Figure 7:
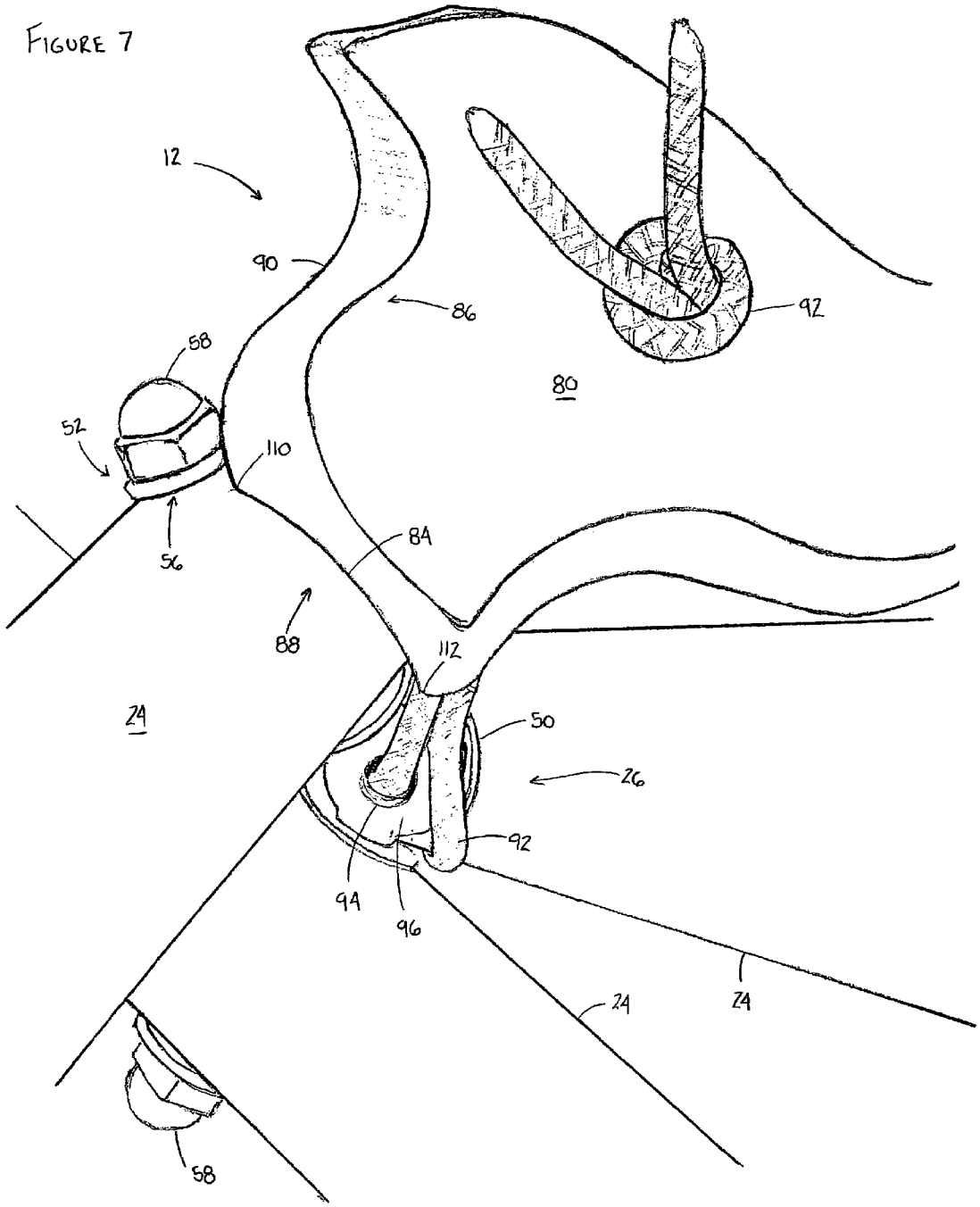
FIG. 7 is an enlarged top perspective view of FIG. 3 showing the locking device attached to a pivoting mechanism.
Figure 8:
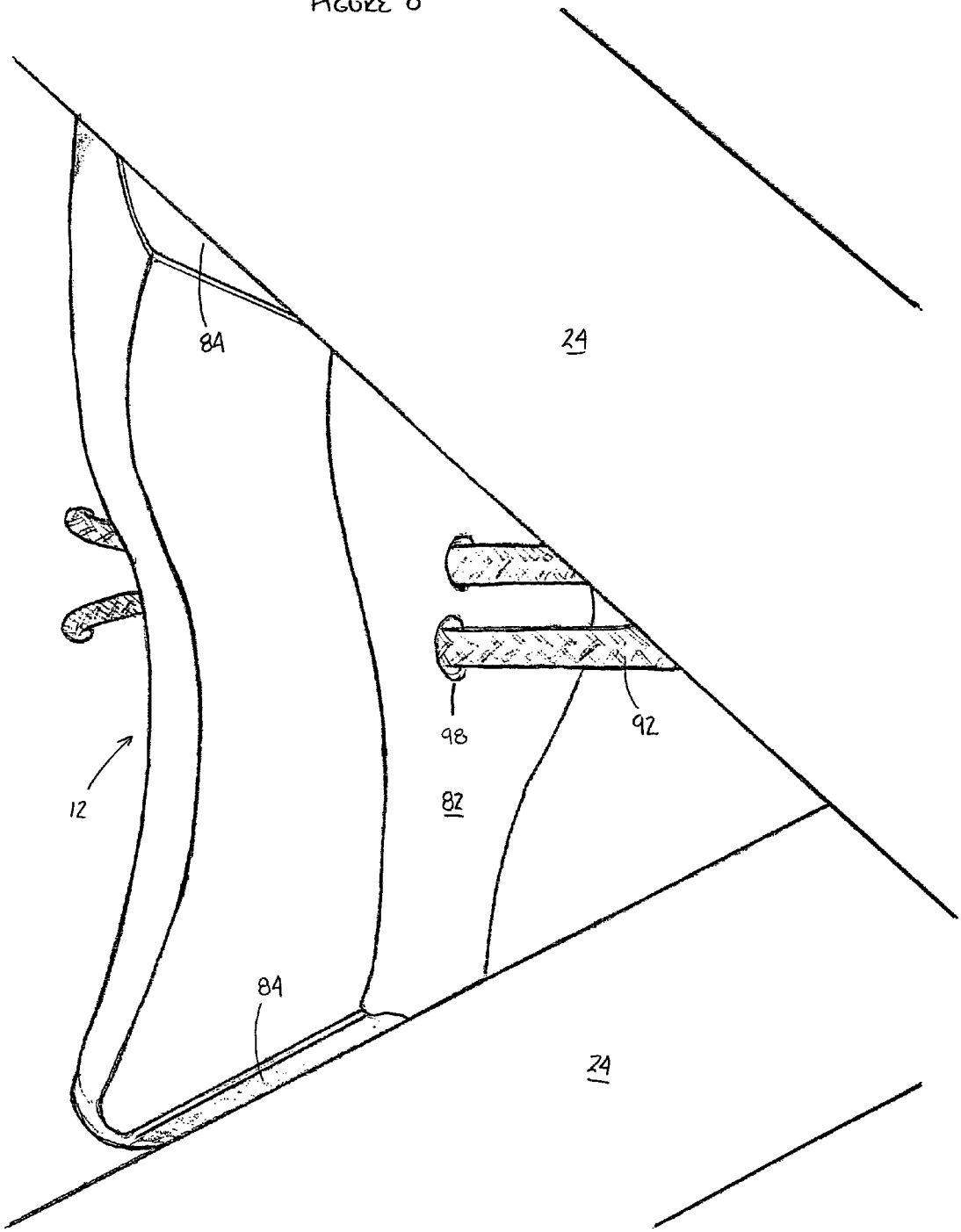
FIGS. 8 and 9 are enlarged side perspective views of the collapsible seat of FIG. 1 showing the locking device fully engaged to the legs of the collapsible seat.
Figure 9:
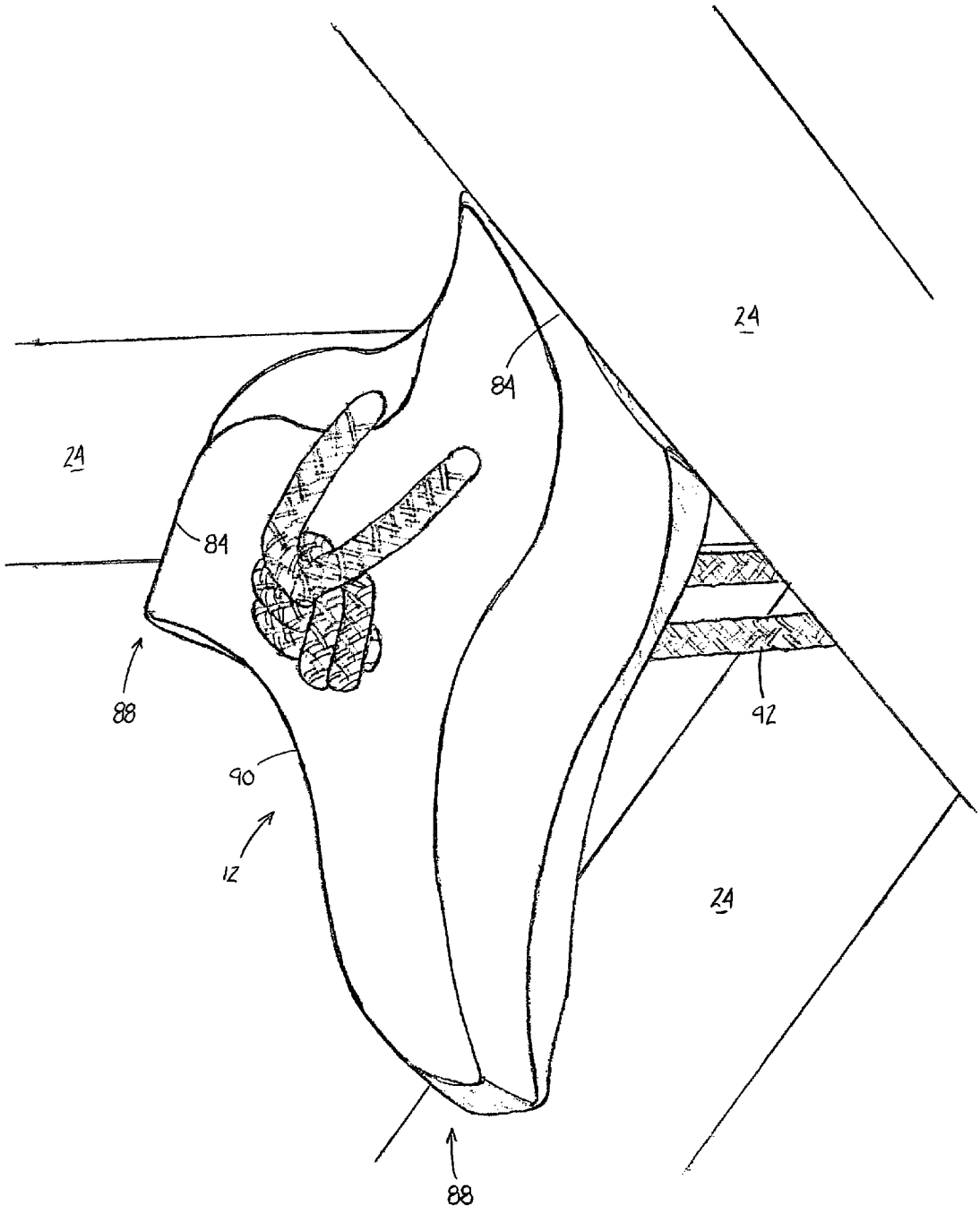

With reference now to FIG. 5-9, the rigidity of the portable collapsible seat 10 is in part obtained by use of the stabilizer, locking device 12 that is removably positioned above the pivoting mechanism 26. The locking device 12 can be formed of a variety of materials such as, but not limited to, wood, metal, plastic and/or other polymer materials, carbon fiber materials, and the like. The locking device 12 generally includes a top wall 80, a bottom wall 82 and side walls 84 adapted to engage inner surfaces of the legs 24. The side walls can be generally planar or arcuate depending on the contour of the inner surfaces of the legs. In the depicted embodiment, each side wall 84 is generally arcuate for mating with an engagement portion of each leg having a generally circular cross-section. As shown in FIG. 5, in this non-limiting embodiment, the locking device 12 has a generally triangular shape and includes side edges 86 interconnected by corners 88; however, it should be appreciated that other shapes, such as a round shape, can be used. At least one of the side edges 86 has a concave midsection which allows the locking device to be loosely inserted between the legs. In the present embodiment, each side edge has a concave midsection 90 disposed between the corners 88. The side edges can be beveled; however, this is not required. As shown in FIGS. 6 and 8, each side wall 84 is outwardly inclined and generally defines a plane which is generally parallel to a longitudinal axis of each corresponding leg in its full setup position (FIG. 1).

With reference again to FIGS. 7-9, the locking device 12 further includes a static connecting and tensioning cord 92 that is designed to removably attach the locking device to the collapsible seat 10; however, this is not required. In use, the static connecting and tensioning cord limits or prevents the longitudinal upward movement of the locking device once the locking device is properly secured between the legs 24. The static connecting and tensioning cord can comprise a non-elastic material, such as a rope or allthread, or an elastic material, such as a bungee cord. To secure the static connecting and tensioning cord to the locking device, the static cord can be anchored to the pivoting mechanism 26. In the depicted embodiment, the static connecting and tensioning cord is a rope which is threaded through an aperture 94 located in a central hub 96 of the Y-bolt 50. Opposed ends of the static connecting and tensioning cord are threaded through a pair of holes 98 (FIG. 8) centrally located in the locking device. The opposed ends can then be secured together. As can be appreciated, other arrangements can be used to removably attach the locking device 12 to the collapsible seat 10.

If it is desired to move the foldable seat 10 from the collapsed position (FIG. 2) to the expanded, setup position (FIG. 1), each leg 24 is partially pivoted about the pivoting mechanism 26 (FIG. 3). The seat portion 20 is mounted to the legs by inserting the upper end 22 of each leg into the open pocket 42. The locking device, which can hang between the legs so that legs 24 are seated in the concave midsection 90 disposed between the corners 88 of the locking device. The locking device can then be secured by simply rotating the locking device between the legs. As the locking device is being twisted, a first side edge 110 (FIGS. 6 and 7) of each side wall 84, which projects slightly outwardly from the side wall 84, engages the inner surface of the leg. As the locking device continues to rotate, the first side edge moves over the inner surface of the leg, the leg then engaging the side wall 84 of the locking device. The locking device is prevented from further rotation by a second side edge 112 of each side wall. The second side edge also projects outwardly from the side wall, slightly farther than the first side edge. Once secured (FIG. 9), the side walls 84 engage and wedge outwardly the inner surfaces of the legs 24. The side edges prevent each side wall from disengaging the leg 24 and the static connecting and tensioning cord 92 prevents the longitudinal movement of the locking device.

Alternatively, the locking device 12 can spring into engagement with the seat legs 24. In this non-limiting embodiment, the static cord is made from an elastic material which allows the side walls 84 of the locking device 12 to be placed directly into contact with the legs 24.

Figure 10:
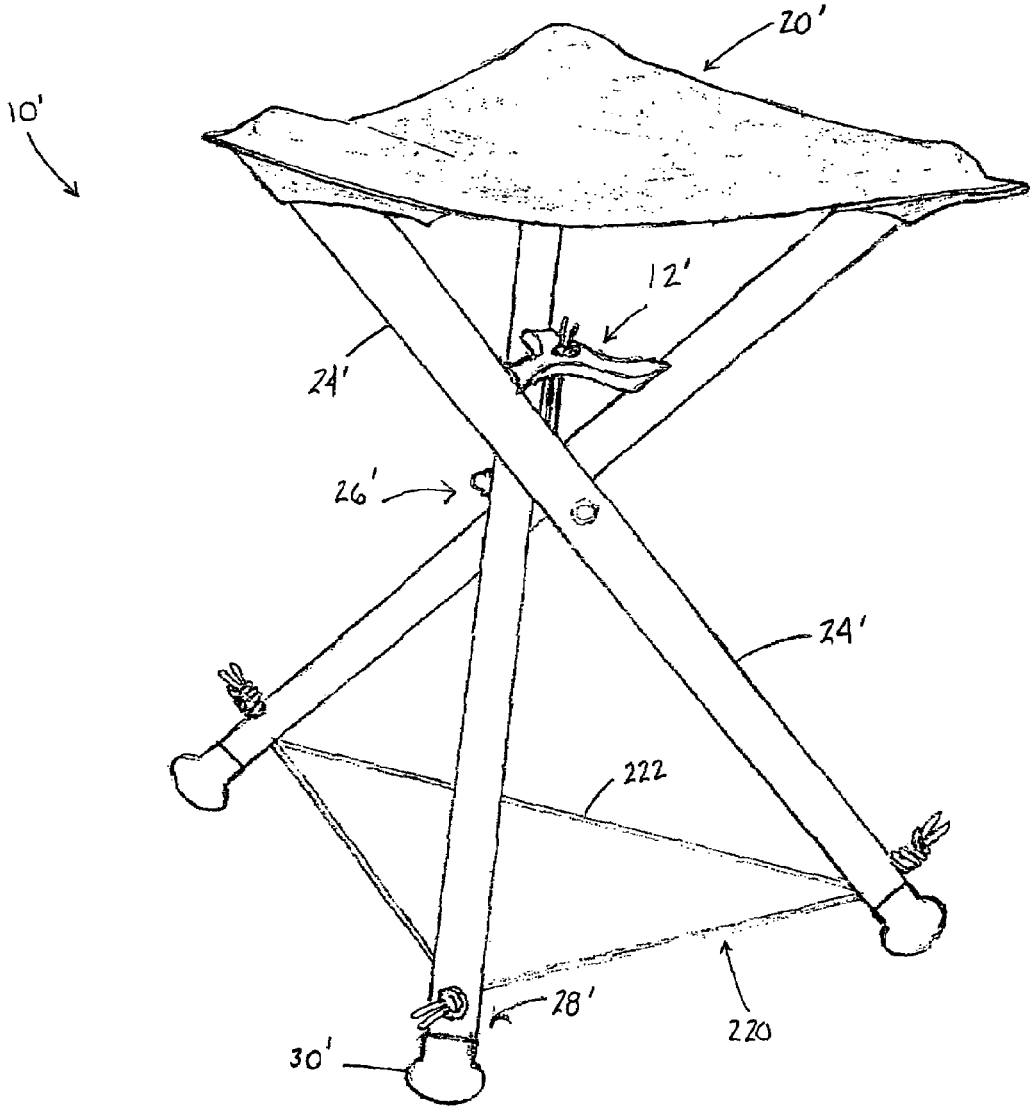
FIG. 10 is a side perspective view of a collapsible seat in an expanded setup position including a locking device in accordance with a second embodiment of the present invention.
Figure 11:
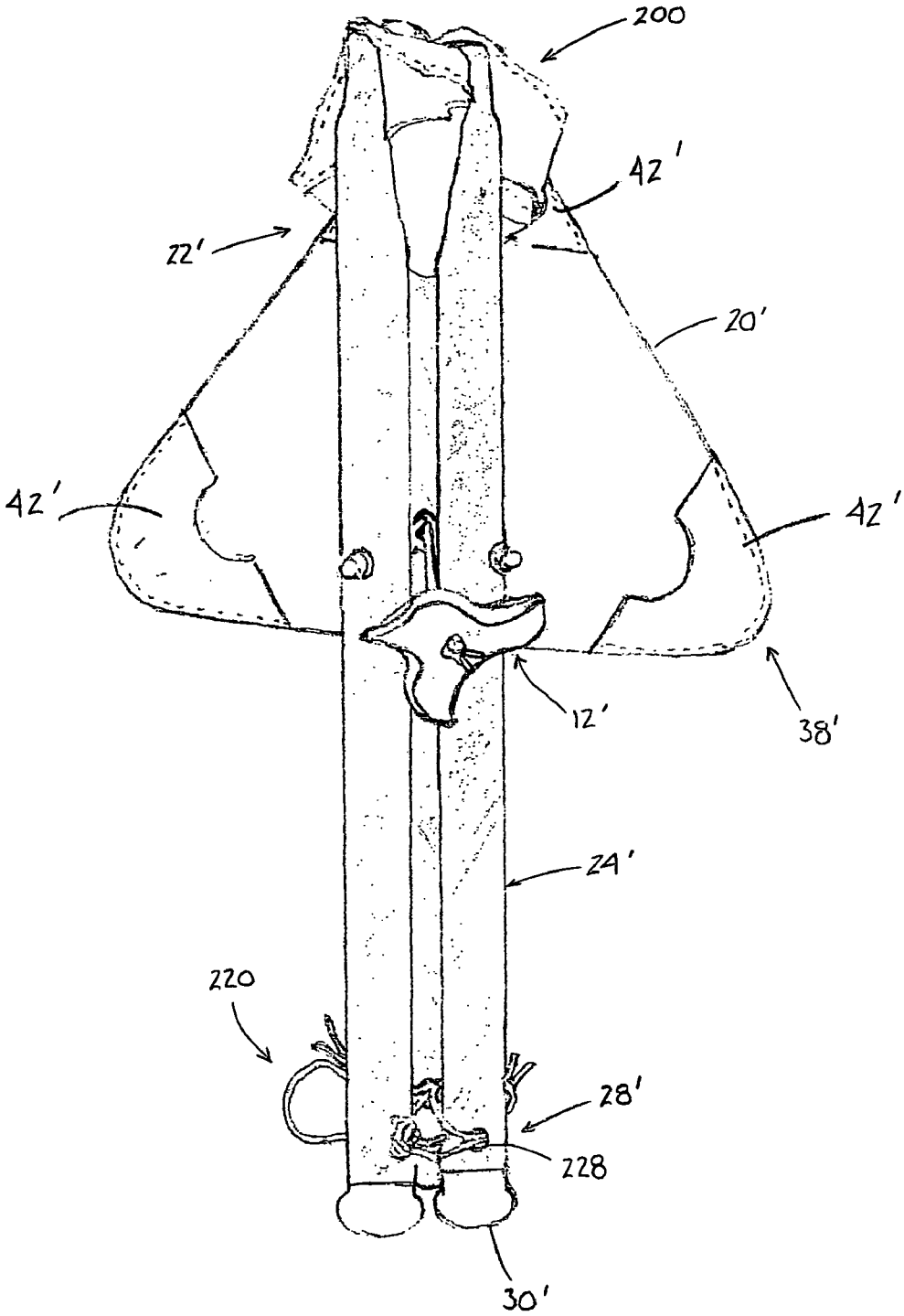
FIG. 11 is a side perspective view of the collapsible seat of FIG. 10 in a fully collapsed position.
Figure 12:
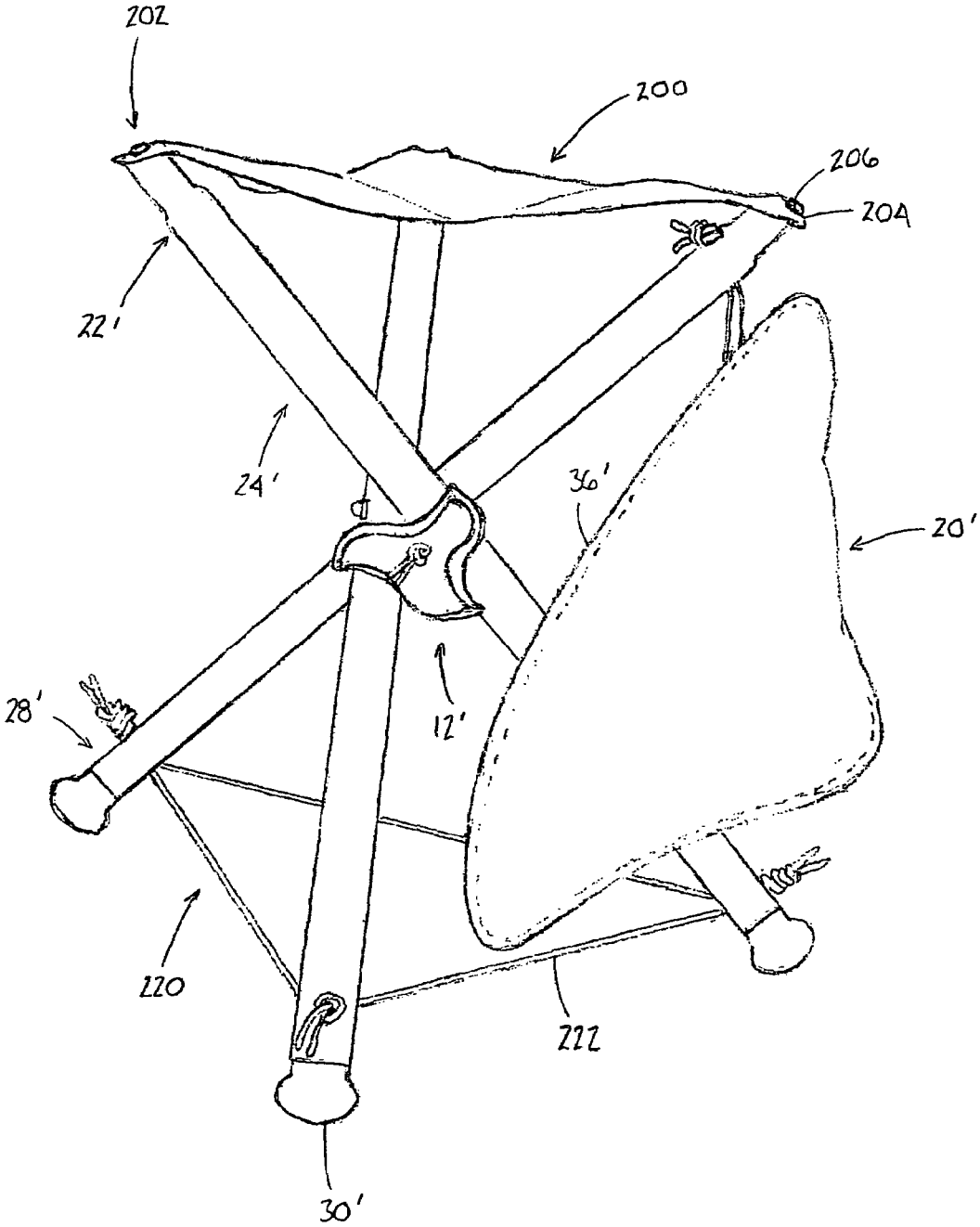
FIG. 12 is a side perspective view of the collapsible seat of FIG. 10 in a partially expanded position.

With reference now to FIGS. 10-12, a portable collapsible seat in accordance with a second embodiment of the present invention is illustrated. Since most of the structure and function is substantially identical, reference numerals with a single primed suffix (') refer to like components (e.g., locking device 12 is referred to by reference numeral 12'), and new numerals identify new components.

Similar to the previous embodiment, the collapsible seat 10' generally includes a a stabilizing, locking device 12', a support surface or seat portion 20' removably connected to an upper end 22' of at least three axially extending legs 24' that converge towards and are pivotally connected to a pivoting mechanism 26'. A lower or bottom end 28' of each leg can include an end cap 30' that is attached thereto for gripping the supporting surface.

With continued reference to FIGS. 10-12, the seat portion 20' can include stitched side edges 36' and corners 38'; however, this is not required. An underside of each corner includes a downwardly open pocket 42' which receives the upper end 22' of one of the legs 24' therein. The pockets can be used to releasably secure the seat portion to the legs.

A limiter device can extend between the legs for preventing the legs from spreading beyond a predetermined supporting position. In the depicted embodiment, the limiting device includes a preseat 200 attached to the upper ends 22' of two or more of the legs 24'. The preseat generally has a contour which matches the contour of the seat portion 20'; although this is not required. In this embodiment, the preseat spans between the upper ends 22' of the legs 24' in a generally triangular configuration. Each corner 202 of the preseat includes eyelets 204, which can be made from metal, adapted to receive a fastener 206. The fastener extends through the eyelet and threadingly engages a hole (not shown) located on the upper end of each leg thereby anchoring the preseat to the legs. The preseat 200 can also or alternatively be used to prevent the legs from stretching the pockets 42' of the seat portion 20', which, in turn, could cause the upper ends 22' of the legs 24' to slide out of the pockets. In this regard, the preseat is a secondary seat which can support and relieve stress of the seat portion 20'. The preseat 200 can be made of a sturdy flexible material to facilitate in the collapsing of the seat (FIG. 11), such as, but not limited to, leather, Kevlar, Nylon, cotton, linen, and the like.

Similar to the first embodiment, the collapsible seat 10' can include a limiter cord 220 coupled to the lower end 28' of two or more of the legs 24' to form a loop for preventing the legs from spreading beyond a predetermined supporting position. The limiter cord 220 can also or alternatively be used to as a foot rest. In this embodiment, the limiter cord 220 includes equal length sections 222, however, this is not required. The sections 222 span between the lower ends 28' of the legs 24' in a generally triangular configuration. Each section of the limiter cord has opposed ends threaded through cord openings 228 located in each leg lower end. The ends of each section 222 can be tied, thereby securing the limiter cord sections to the legs; although, this is not required.

Similar to the previous embodiment, the rigidity of the portable collapsible seat 10' is in part obtained by use of the. stabilizer, locking device 12' that is removably positioned above the pivoting mechanism 26'. As to a further discussion of the manner of usage and operation of the locking device, the same should be apparent from the above description relative to the first embodiment. Accordingly, no further discussion relating to the manner and usage will be provided.

As is evident from the above, the portable collapsible seat 10 overcomes the stability problems of the prior art stools by virtue of the removable locking device 12 mounted to the pivoting mechanism 26. The collapsible seat 10 is made rigid via the locking device 12. When the seat is in the collapsed position, the locking device can be designed to hang freely by the static connecting and tensioning cord 92 which is anchored to the central Y-bolt 50; however, this is not required. When the seat is in the expanded setup position, in one non-limiting embodiment, the locking device 12 is placed between the legs 24 above the Y-bolt 50 and is rotated or twisted wedging apart the three legs. This, in turn, causes the limiter device 66 to become taut. The limiter device limits the movement and position of the legs when the seat is in the expanded, setup position; however, this is not required. It should also be understood that the locking device of the present invention may also be practiced with portable collapsible seats having more than three legs.

The present invention has been described with reference to the preferred embodiments. Obviously, modifications and alterations will occur to others upon reading and understanding the preceding detailed description. It is intended that the present invention be construed as including all such modifications and alterations insofar as they come within the scope of the appended claims or the equivalents thereof.

What is claimed is:

1. A collapsible seat with removable locking mechanism, said collapsible seat including at least three legs, a pivoting mechanism for pivotally connecting together said legs and a seat portion mounted to an upper end of said legs, said locking mechanism comprising:

a locking device, distinctly triangular in plan view;

said locking device having three concave side edges interconnected by three corners;

each corner includes an angled surface configured to matingly engage an inner surface of one of said legs;

said locking device is removably positioned in a locked position above and spaced apart from said pivoting mechanism by loosely seating said inner surfaces of said legs in said concave side edges of said locking device and then twisting said locking device to engage said angled surfaces of said corners with said inner surfaces of said legs, thereby wedging apart said legs and increasing a rigidity of said collapsible seat in an expanded position.

2. The collapsible seat of claim 1, further comprising a static cord connecting said locking device to said pivoting mechanism, and tensioning said locking device with respect to said pivoting mechanism in said locked position.

3. The collapsible seat of claim 1, wherein each angled surface of the locking device includes a concave shape, said concave shape preventing said angled surface from disengaging from said inner surface of said leg.

4. A collapsible seat with removable locking mechanism, said collapsible seat including at least three legs, a pivoting mechanism for pivotally connecting together said legs, a limiting device extending between said legs for preventing said legs from spreading beyond a predetermined supporting position, and a seat portion mounted to an upper end of said legs, said locking mechanism comprising:

a locking device, distinctly triangular in plan view;

said locking device having three concave side edges interconnected by three corners;

each corner includes an angled surface configured to matingly engage an inner surface of one of said legs;

a connecting cord secures and tensions said locking device to said pivoting mechanism in a locked position above and spaced apart from said pivoting mechanism, said locking device is positioned in said locked position by loosely seating said inner surfaces of said legs in said concave side edges of said locking device and then twisting said locking device to engage said angled surfaces of said corners with said inner surfaces of said legs, thereby wedging apart said legs and increasing a rigidity of said collapsible seat in an expanded position.

5. The collapsible seat of claim 4, wherein each angled surface of said locking device is outwardly inclined, said angled surfaces wedging apart said legs of said collapsible seat.

6. The collapsible seat of claim 4, wherein each angled surface of the locking device includes a concave shape, said concave shape preventing said angled surface from disengaging from said inner surface of said leg.

* * * * *